United States Patent [19]

Kazaoka et al.

[11] Patent Number: 5,006,052

[45] Date of Patent: Apr. 9, 1991

[54] ORBITAL ROTOR COMPRESSOR HAVING AN INLET PASSAGE IN THE ROTOR

[75] Inventors: Kenichi Kazaoka, Nagoya; Hiroshi Okazaki, Kariya, both of Japan

[73] Assignee: Aisin Seiki Kabushiki Kaisha, Kariya, Japan

[21] Appl. No.: 458,510

[22] Filed: Dec. 28, 1989

[30] Foreign Application Priority Data

Dec. 29, 1988 [JP] Japan ..... 63-331388

[51] Int. Cl.[5] ..... F04C 18/02; F04C 29/08

[52] U.S. Cl. ..... 418/61.1; 418/64; 418/183

[58] Field of Search ..... 418/61.1, 64, 183

[56] References Cited

U.S. PATENT DOCUMENTS

| | | | |
|---|---|---|---|
| 2,100,014 | 11/1937 | McCracken | 418/64 |
| 2,423,507 | 7/1947 | Lawton | 418/61.1 |
| 4,097,205 | 6/1978 | Miles | 418/61.1 |
| 4,280,798 | 7/1981 | Gurley | 418/64 |

FOREIGN PATENT DOCUMENTS

| | | | |
|---|---|---|---|
| 284980 | 4/1931 | Italy | 418/64 |

*Primary Examiner*—Leonard E. Smith
*Assistant Examiner*—David L. Cavanaugh
*Attorney, Agent, or Firm*—Burns, Doane, Swecker & Mathis

[57] ABSTRACT

A compressor arrangement is provided with an eccentrically controlled slidable vane. The vane is movable to release excessive pressure build-up so as to eliminate requirements for a safety valve.

1 Claim, 6 Drawing Sheets

ORBITAL ROTOR COMPRESSOR HAVING AN INLET PASSAGE IN THE ROTOR

BACKGROUND OF THE INVENTION

1. Field of the Invention

This invention relates to a compressor and especially for a compressor for use in a cooling system.

2. Description of the Related Art

A conventional cooling system for an automobile is shown in FIG. 6. As shown in FIG. 6, the cooling system has an expansion valve 1, an evaporator 2, a compressor 3 and a condenser 4. A coolant is expanded by the expansion valve 1 and is changed into a low temperature gas. A gas coolant is sent to the evaporator 2 which is mounted in the interior of the automobile. The evaporator 2 absorbs heat from the interior air. The absorbed heat is transferred to the gas coolant while the coolant maintains its gaseous state. This arrangement lowers interior temperature. The heated gas coolant is transmitted to the compressor 3 and is compressed into a pressurized high temperature gas. The pressurized high temperature gas then flows to the condenser 4. The pressurized high temperature gas transfers heat to the condenser 4 and is changed into a low temperature liquid coolant. The foregoing cycle is continued in order to maintain room temperature constant.

A conventional compressor has a piston which is movable in response to a rotating slant plate or has an eccentric rotor in order to change a heated gas coolant into a heated high pressure gas coolant. For example, Japanese Patent Laid-Open 57 (1982) - 41493 shows a vane-type compressor. This compressor has an eccentric rotor in a cylinder. The rotor rotates eccentrically in contact with the cylinder wall. The vane is provided at the cylinder and extends to the rotor. A working space is provided by the rotor, the vane and the cylinder. The rotation of the rotor changes the volume of the working space and compresses a coolant gas. This type of compressor is powered by the output of an engine, however, it is not energy efficient and engine power output loss in driving the compressor is large. If rapid cooling is needed, a conventional system reduces the amount of air flow through the condenser in order to decrease the load. Therefore, it takes time to lower the temperature. Further, the compressor works constantly even after the temperature reaches the set temperature. As such, energy consumption is increased and engine output energy is wasted. Because the vane arrangement is provided at the cylinder, the size of the compressor may be too large to mount in an automobile due to small space availability. Additionally, when the rotational speed of the rotor is high, movement of the vane is also increased. A force of inertia effects the contacts between the vane and the rotor. The vane has to be pressed to the rotor by a strong spring against the force of inertia. Due to this pressing contact, the rotor is worn by the contact of the vane.

SUMMARY OF A PREFERRED EMBODIMENT OF THE INVENTION

An object of the present invention is to provide a compressor which overcomes the above-mentioned drawbacks, especially, a compressor which has a variable volume.

In accordance with the invention, the compressor includes a cylinder, a crank shaft having an eccentric shaft, and a rotor positioned in the cylinder and supported by the eccentric shaft. End plates are fixed to both ends of the cylinder which has an inlet passage connecting to the inside of the cylinder. An interior space is provided by the cylinder, rotor and end plate. An inlet port is provided at the rotor in order to connect the inlet passage with the interior space and an outlet port is provided at the cylinder and connected with the interior space, wherein the volume of the space is varied by movement of the rotor when driven by the crank shaft.

In the present invention, the speed of the end of the vane is relatively slow so that friction between the inner side of the cylinder is relatively low. The vane is installed in the rotor and the stroke of the vane is relatively small. Therefore, the size of the compressor can be made smaller and the load to the spring which supports the vane can be smaller. Further, if the pressure in the interior space is excessive, the vane can slide to release the excessive pressure. This arrangement eliminates the need for a safety valve and the compressor does not need to be provided with an inlet valve so that the size of the compressor can be smaller and more cost effective.

BRIEF DESCRIPTION OF THE DRAWINGS

The objects and advantages of the invention will become apparent from the following detailed description of preferred embodiments thereof in connection with the accompanying drawings in which.

DETAILED DESCRIPTION OF A PREFERRED EMBODIMENT OF THE INVENTION

Figure 1:
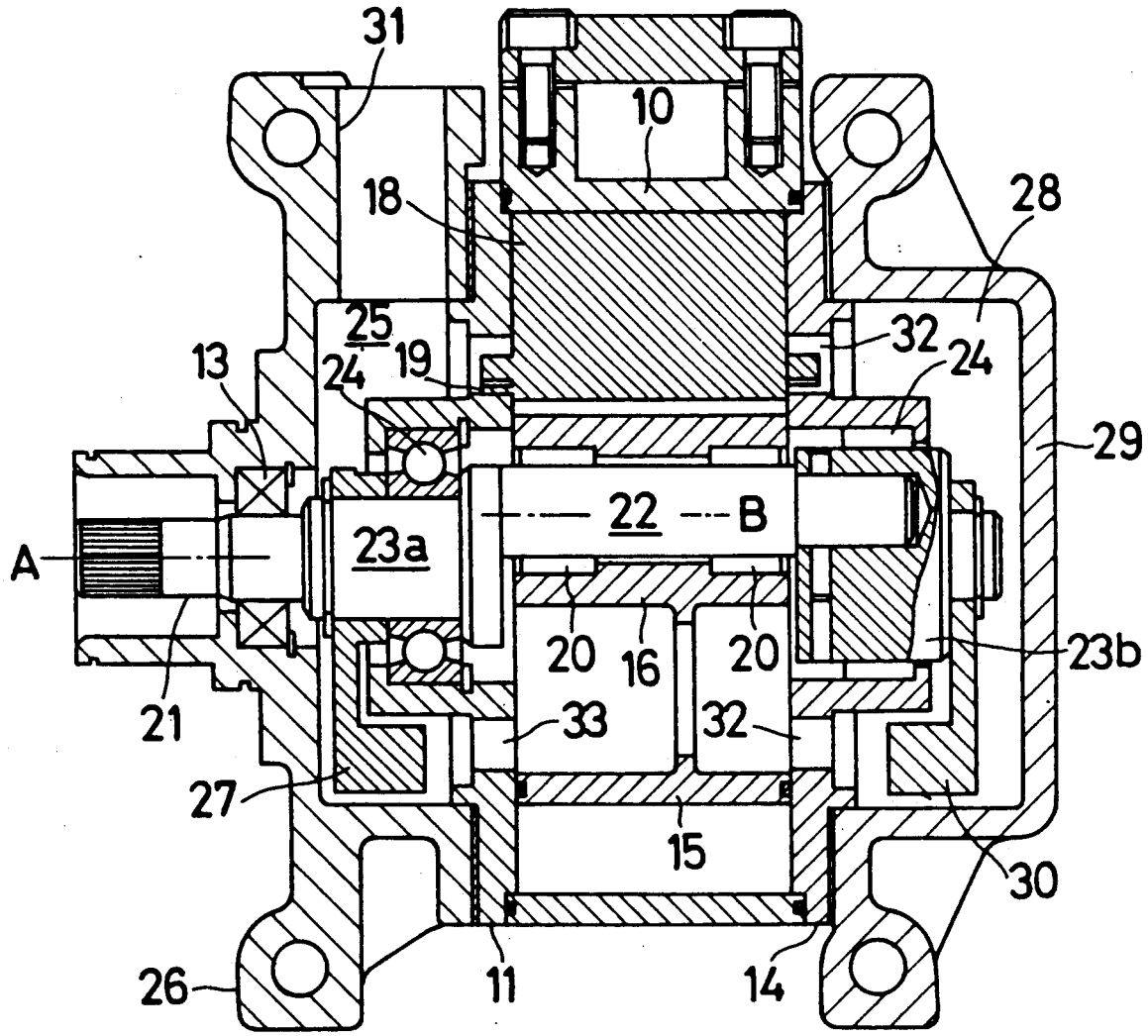
FIG. 1 is a cross-sectional view of an embodiment of a compressor in accordance with the present invention.
Figure 2:
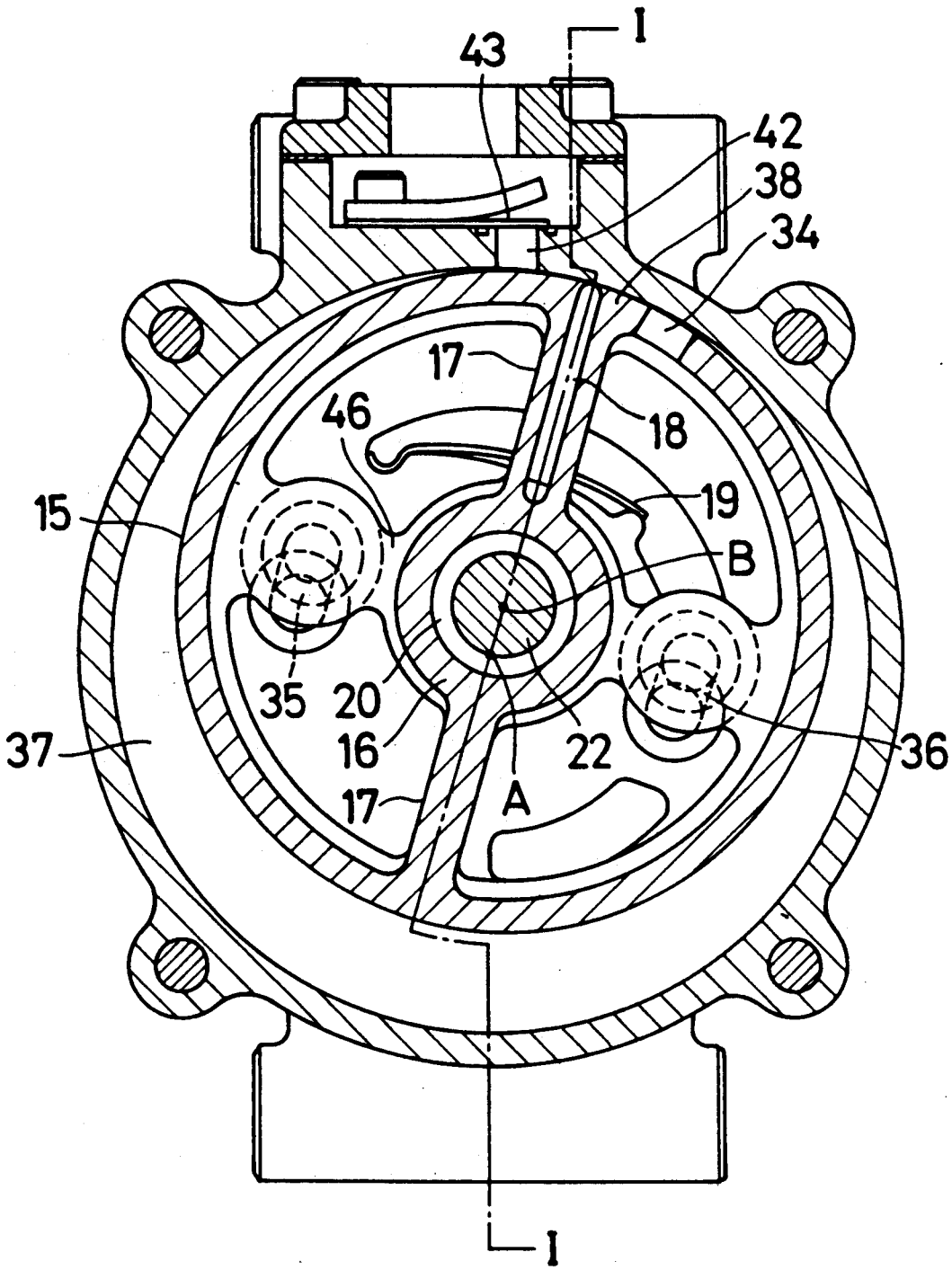
FIG. 2 is a cross-sectional view of the compressor of FIG. 1.

As shown in FIGS. 1 and 2, a front end plate 11 is fixed to the front side of a cylinder 10 by a bolt 12 through a seal member, and a rear end plate 14 is fixed to the rear side of the cylinder 10 by bolt through a seal member. A rotor 15 is positioned in the cylinder 10. A hub 16 is provided at the center of the rotor 15. The hub 16 and the rotor 15 are connected by a pair of ribs 17. At one end of the rib 17, there is provided a groove 17*a*. A vane 18 is inserted into the groove 17*a* of the rib 17 and is forced by a plate spring 19 toward the inner surface 10*a* of the cylinder 10. The vane 18 is in constant contact with the inner surface of the cylinder 10. The hub 16 is rotatably supported by an eccentric shaft 22 of a crank shaft 21 through a bearing 20. Both ends 23*a* and 23*b* on the center axis of the crank shaft 21 are supported by the front and rear end plates 11 and 14 through the bearings 24. A front cover 26 is sealingly fixed to the front end plate 11 so that a front space 25 is made between the cover 26 and the end plate 11. A seal member 13 isolates the front space 25 from atmospheric conditions. A front balancer or counterweight 27, fixed to the shaft end 23*a* is disposed in the front space 25.

The front space 25 is connected with an inlet 31. A rear space 28 is also provided around the rear end plate 14 by a rear cover 29. In the rear space 28, a rear balancer or counterweight 30, fixed to the shaft end 23*b*, is disposed. The rear end plate 14 has a passage 32 which connects the rear space 28 and the inner space of the rotor 15. The front end plate 11 has a passage 33 which connects the front space 25 with the inner space of the rotor 15. An inlet 34 is provided along the periphery of the rotor 15 so that a fluid in the rotor 15 is supplied to a working space defined between the rotor 15 and the cylinder 10. A fluid drawn into the inlet 31 can be supplied to the working space through the front space 25, the passage 33, the inner space of the rotor 15, the passage 32, the rear space 28 and the inlet 34 when the inlet 34 is opened to the working space.

Figure 3:
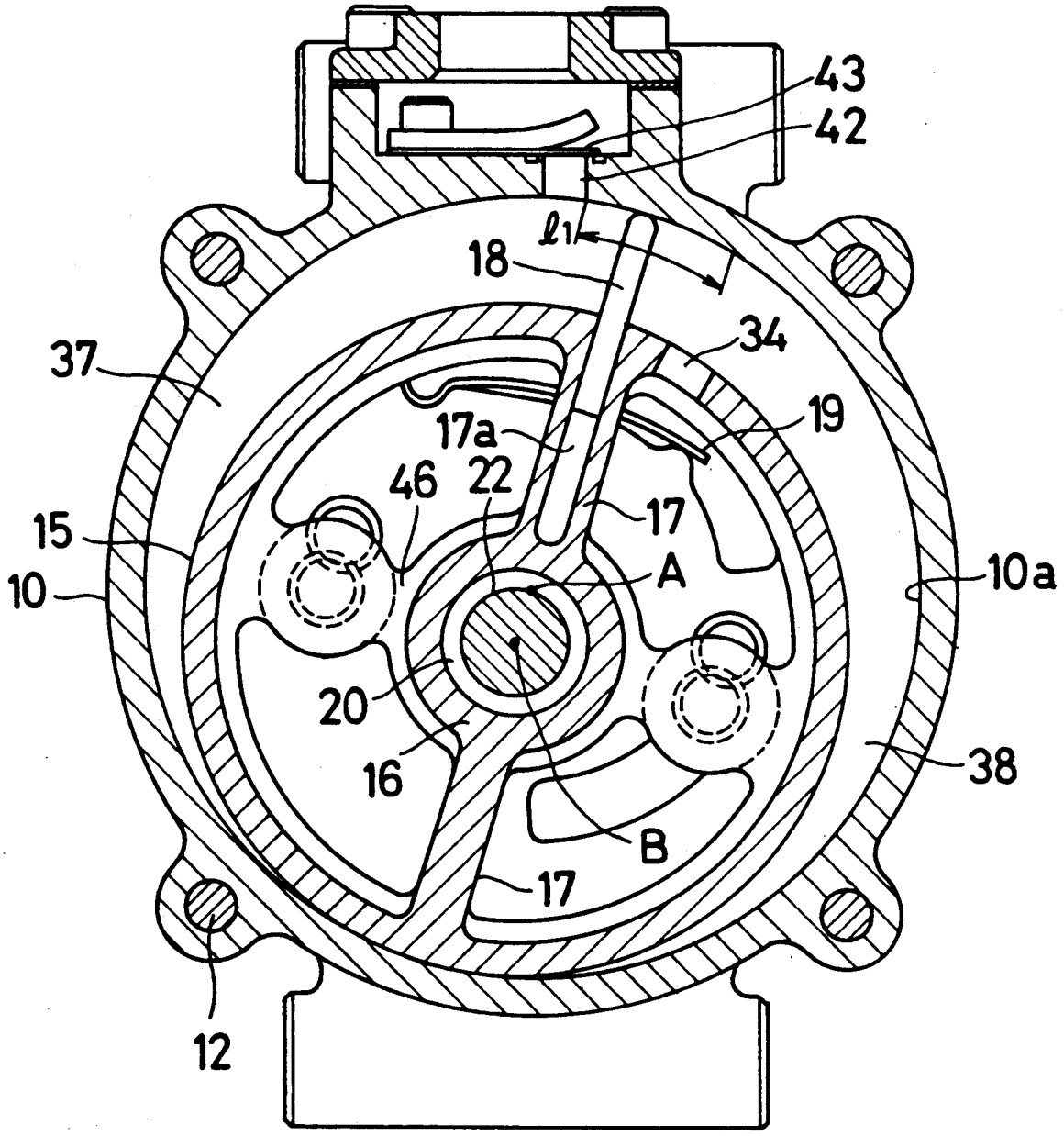
FIG. 3 is another cross-sectional view of the compressor of the present invention.

The center axis A of the end shafts 23*a* and 23*b* is eccentric to the center axis B of the eccentric shaft 22. The eccentric shaft 22 rotates eccentrically on the center axis A with a radius (A - B). The hub 16 of the rotor 15 is supported by the eccentric shaft 22 through the bearing 20 and is provided with a link mechanism discussed below. The rotor 15 moves reciprocally across a stroke length of $l_1$ (FIG. 3).

Figure 5:
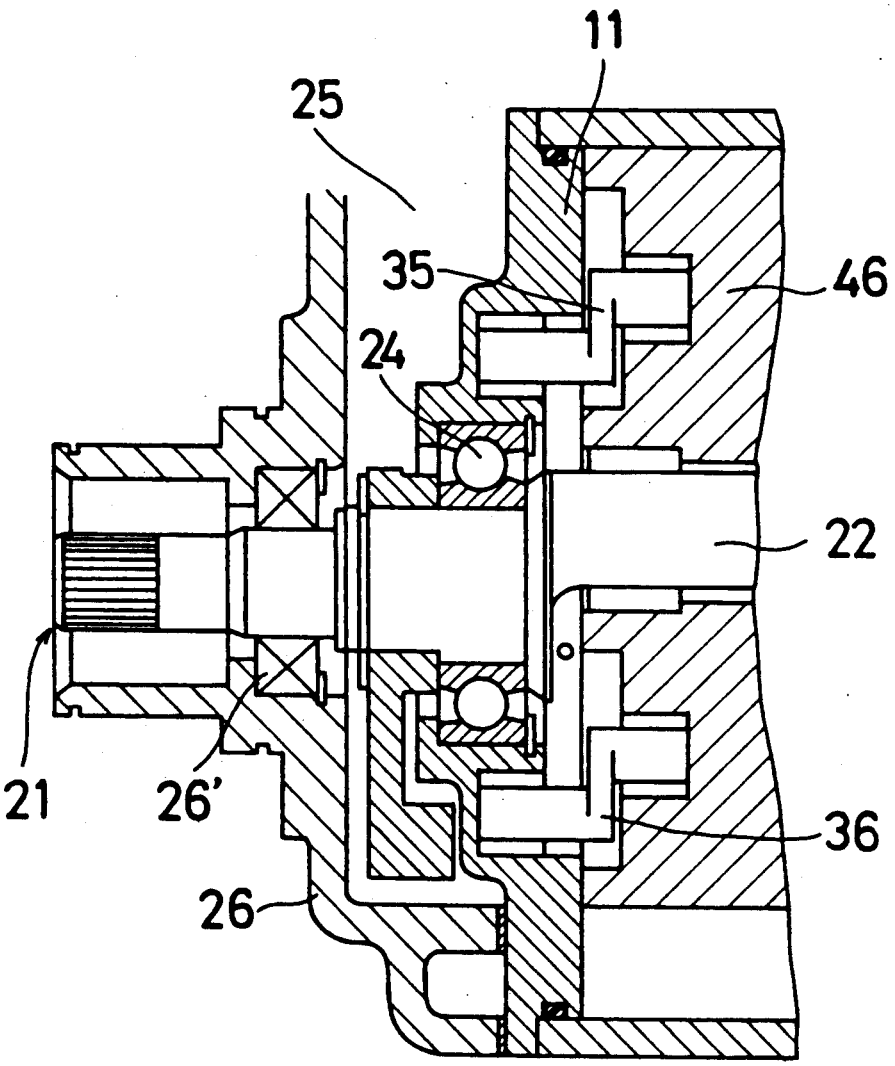
FIG. 5 is a cross-sectional view of the link mechanism of the compressor of the present invention.
Figure 6:
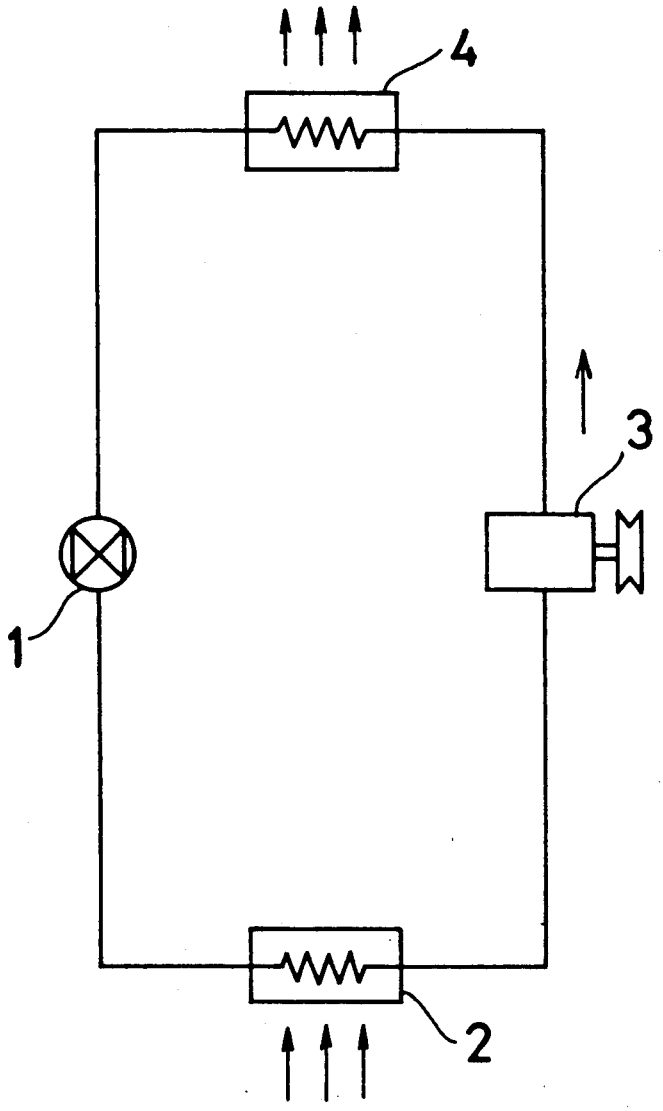
Fig. 6 PRIOR ART
FIG. 6 is a diagram showing a conventional cooling system.

Referring to FIG. 5, links 35 and 36 are provided between a rib portion 46 of the rotor 15 and the front end plate 11 and are rotatably supported by the plate 11. The eccentric shaft 22 of the crank shaft 21 and the links 35 and 36 are a parallel link mechanism. This parallel link mechanism limits movement of the rotor. The link mechanism prevents the rotor 15 from revolving on its own axis against cylinder 10 so that the rotor 15 reciprocates with a stroke of $l_1$. The eccentric length (A - B) between the crank shaft 21 and the eccentric shaft 22 is equal to the length of the links 35 and 36 and is set to a length which will permit the vane to move along the stroke length $l_1$, between the inlet 34 and outlet 42.

Referring to FIGS. 1, 2, 3 and 4, operation of the compressor will be explained with respect to the volume of the working space. When the crank shaft 21 rotates in a clockwise direction, volume of the chamber 38 is increased and volume of the chamber 37 is reduced. Gas in the passages 31, 32 and 33 is going to be drawn into the chamber 38 through the inlet 34. In a cycle between FIG. 4(*a*) (which corresponds to the rotor position of FIG. 2) and FIG. 4(*b*), the volume of the chamber 37 is compressed and the gas goes to the chamber 38 through the inlet 34. In the cycle between FIG. 4(*b*) and FIG. 4(*c*) (which corresponds to FIG. 3), the vane 18 moves gradually toward the outlet 42. The compressed gas in the chamber 37 begins to be output from the outlet 42 while the volume of the chamber 38 is being increased. During this cycle, movement of the rotor 15 is small and the vane 18 moves only a small distance in the radial direction. Therefore, even if the crank shaft 21 rotates fast, the force of inertia of the vane 18 is relatively small. The vane 18 continues to move toward the outlet 42 in this cycle.

Figure 4:
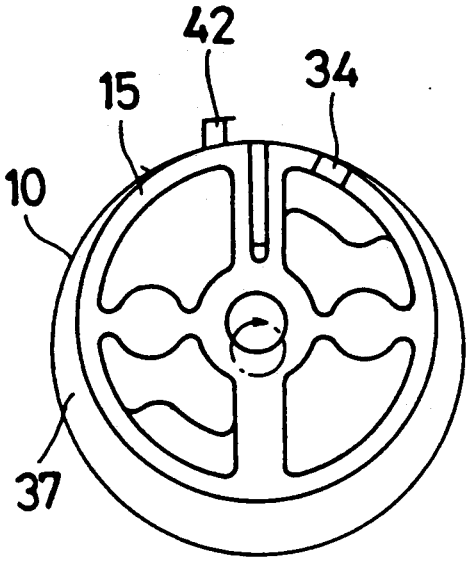
FIG. 4 is a drawing showing the compression cycle of the compressor of the present invention.
Figure 4:
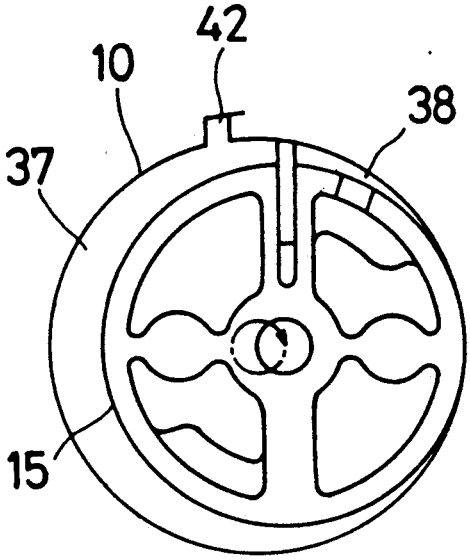
Figure 4:
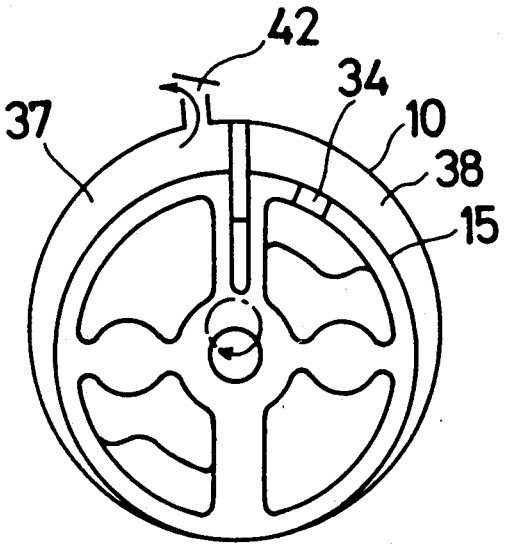
Figure 4:
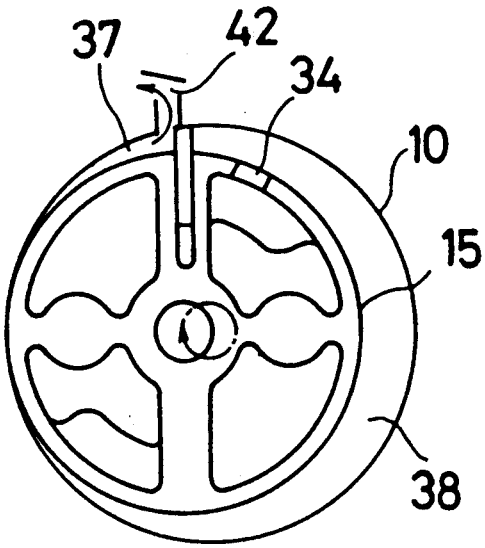

FIG. 4(*d*) shows when the crank shaft 21 has rotated 90 degrees past the position shown in FIG. 4(*c*). In this cycle, the volume of the chamber 38 is further expanded and the volume of the chamber 37 is further decreased. Gas in the chamber 37 passes through the outlet 42 through the one way valve 43. Gas is also being drawn into the chamber 38 from the inlet 34. During this cycle, the vane 18 is gradually moving toward the outlet 42 so that the volume of the chamber 37 is further decreased and the volume of the chamber 38 is further increased. In this cycle, the vane 18 moves a short distance in the radial direction and the force of inertia of the vane 18 is very small. When the crank shaft 21 rotates further, the rotor 15 moves back into the position as shown in FIG. 4(*a*) and the cycle is continued.

Although the invention has been described in connection with preferred embodiments thereof, it will be appreciated by those skilled in the art that additions, substitutions, modifications, and deletions not specifically described, may be made without departing from the spirit and scope of the invention as defined in the appended claims.

What is claimed is:

1. A compressor comprising:

a cylinder, a crank shaft having an eccentric shaft, a hub member rotatably supported by said crank shaft, a rotor disposed in said cylinder and supported by said eccentric shaft, end plates fixed to each end of said cylinder and provided with inlet passages extending to the inside of said cylinder, a support element extending between and connecting said hub member and said rotor and having a groove provided therein, a vane member disposed in said groove, spring means disposed between said end plates and said vane member for continuously urging said vane member to contact an inner surface of said cylinder, a chamber defined by said cylinder, said rotor and said end plates, an inlet port provided in said rotor to connect said inlet passage with said chamber, and an outlet port provided in said cylinder to communicate with said chamber, wherein volume of said chamber is varied by movement of said rotor driven by said crank shaft.

* * * * *